US006739374B1

(12) United States Patent
Mouzakis

(10) Patent No.: US 6,739,374 B1
(45) Date of Patent: May 25, 2004

(54) METHOD AND APPARATUS FOR RETAINING SLATS OF A VERTICAL BLIND

(76) Inventor: George E. Mouzakis, P.O. Box 925, Largo, FL (US) 33779-0925

( * ) Notice: Subject to any disclaimer, the term of this patent is extended or adjusted under 35 U.S.C. 154(b) by 0 days.

(21) Appl. No.: 10/180,411

(22) Filed: Jun. 26, 2002

(51) Int. Cl.[7] ..... E06B 9/36

(52) U.S. Cl. ..... 160/349.2; 160/178.1 V; 24/326

(58) Field of Search ..... 160/236, 349.2, 160/178.1 V, 349.1, 38, 330; 24/543, 326, 335

(56) References Cited

U.S. PATENT DOCUMENTS 1,654,002 A 12/1927 Kleinhammer
2,037,864 A * 4/1936 Mix ..... 24/66.2
D363,387 S * 10/1995 Potts ..... D6/580
5,692,553 A 12/1997 Jensen
5,947,177 A 9/1999 Kratzer
6,244,326 B1 6/2001 Grieco

* cited by examiner

*Primary Examiner*—Blair M. Johnson
(74) *Attorney, Agent, or Firm*—David Kiewit

(57) ABSTRACT

Several fastening arrangements can hold a group of slats of a vertical blind in a fairly tightly juxtaposed arrangement that minimizes rattling caused by wind or ventilation air currents. The combination of a clip, that can be clipped around a selected one of the slats, and a flexible, string-like tie allows a user to gather other slats of the group next to the selected one and to tie the gathered slats together. In other cases, at least some of the slats of a blind are modified by the introduction of lateral notches that cooperate with string-like ties to bind a group of slats together.

9 Claims, 5 Drawing Sheets

METHOD AND APPARATUS FOR RETAINING SLATS OF A VERTICAL BLIND

FIELD OF THE INVENTION

This invention relates generally to vertical blinds of the type that are conventionally installed in residential and commercial buildings and, more specifically, to apparatus and method for tying groups of slats of a vertical blind together.

BACKGROUND

Conventional vertical blinds generally comprise some selected number of slats having a single selected width over most of their length and a single selected thickness. The slats comprising a blind depend some selected distance from a horizontally disposed track and track mechanism. These blinds may be drawn to an open position, which may have all of the vertical slats stacked at one side of the blind, or which may have half of the slats at one side and half at the other. They may also be drawn to a closed position in which all of the vertical slats are evenly spaced across the width of the window or sliding glass door. When drawn to the closed position, the slats may be rotated in concert to a position in which they are parallel to the plane of whatever window or sliding glass door they are installed near, thereby completely blocking a view through the window or glass door. Alternatively, they may be rotated to a position in which they are perpendicular to the plane of the window or door, thereby permitting light to enter through the window.

Vertical blinds commonly offer one a dilemma if the window or door with which the blind is associated is to be opened for ventilation. If the blind is drawn to the closed position and the slats rotated so as to block direct sunlight or to obscure the inside of a room from outside viewers, ventilating air moving through the door or window rattles the blinds. This results in a generally unpleasant noise and may cause some of the slats to become misaligned with respect to their neighbors so as to require a manual adjustment by the user. In extreme cases the traversing and rotating mechanism or the slats themselves may be damaged. If the blind is drawn to the open position, the extent of slat rattling is diminished somewhat at the expense of undesired visibility or illumination. Moreover, if the blind is drawn to the open position, various of the blind slats can be tied or clipped to a wall adjacent the window or door, which may further diminish rattling, but which will not necessarily eliminate it.

Notable patented prior art relating to methods and apparatus for retaining window coverings include:

U.S. Pat. No. 5,947,177, wherein Kratzer teaches a "sun-tie" for gathering groups of slats of a vertical blind so that a medial portion of each slat in a group is juxtaposed in an abutting relationship with other slats of the group. The sun-tie comprises a combination of a fixed "anchor pocket" that can be slid over a selected slat and a clip having a fixed size into which the rest of the group of slats can be gathered. Kratzer relies on having some of the slats diverge laterally both above and below the sun-tie in order to keep the anchor pocket from sliding off the selected slat under the influence of gravity. This requires all the slats to be turned parallel to a window. Kratzer's disclosure is herein incorporated by reference.

U.S. Pat. No. 5,692,553, wherein Jensen discloses a two-part slat-retaining clip having a first portion fixedly attached to a wall and a second portion for capturing a group of slats.

U.S. Pat. No. 1,654,002, wherein Kleinhammer teaches a drapery clip that removably fastens around a drape and that has an end fastened to a wall adjacent the window.

SUMMARY OF THE INVENTION

One aspect of the invention is that it provides a clasp for selectively retaining a first vertical blind slat adjacent at least a second vertical blind slat of a plurality of slats comprising a vertical blind. The groups of slats can be juxtaposed when the blind is a closed state, a drawn state or an intermediate state. This clasp comprises an elongate clip portion that comprises two parallel elongate legs flexibly connected together adjacent a first, permanently closed, end of the clip portion. These legs are spaced apart from each other, adjacent the permanently closed end of the clip portion, by at least the thickness of the blind slats that are to be retained. In addition, the respective ends of the legs distal from the permanently closed end of the clip portion are selectively movable toward and away from each other, and at least one of the legs has a respective leg length longer than the slat width. The clip portion also comprises a closure adjacent the second end of the clip portion for releasably connecting the respective distal ends of the two legs so as to define an enclosed area for retaining the first slat. In addition, the clasp comprises a tie-retainer adjacent a selected one of the two ends of the clip portion. The clasp further comprises a string-like tie portion having a length greater than the slat width. One end of the tie portion is attached to the clip portion adjacent that end of the clip portion distal from the tie-retaining portion, and the second end of the tie portion is selectively retained by the tie-retainer when the clip portion is disposed about the first slat and the second slat is retained adjacent to it. In a preferred embodiment, the tie is retained by the tie retainer at any of a selected number of positions so that the tie can be snugly wrapped around one or more other slats so as to retain the other slats in a tightly juxtaposed relationship to the first slat in order to provide a maximum resistance to rattling induced by moving air. In addition to wrapping about one or more of the slats, the tie can be passed around a cord or chain used to control the blind, or can be used to retain the group of slats to a hook or other fixed attachment point on a wall adjacent the window or door associated with the blind.

Another aspect of the invention is the provision of a combination of a clasp and a notched vertical blind slat having a selected slat width along its length except in a notched region where the width is locally reduced by the notch. This combination of the clasp and the notched slat is used for selectively retaining the notched vertical blind slat adjacent at least a second slat of a plurality of slats that make up a vertical blind. This clasp comprises a clip portion defining an elongate internal area having a length generally less than the selected slat width and a bit greater than the width of the notched slat when measured at a base of the notch. The clip portion further comprises two parallel elongate legs flexibly connected together adjacent a first, permanently closed, end of the clip portion and spaced apart from each other adjacent the permanently closed end of the clip portion. The respective ends of the legs distal from the permanently closed end of the clip portion are selectively movable toward and away from each other. In addition, the clip portion comprises a closure adjacent its second end for releasably connecting the respective distal ends of the two legs so as to close the clip portion about the notched portion of the notched slat. There is also a tie-retainer adjacent a selected one of the two ends of the clip portion. The clasp further comprises a string-like tie portion having a length greater than the selected slat width. One end of the tie portion is attached to the clip portion adjacent that end of the clip portion distal from the tie-retaining portion, and the second end of the tie portion is retained by the tie-retainer when the clip portion is disposed about the first slat and the second slat is retained adjacent to it.

Another aspect of the invention is that it provides a method for retaining a plurality of slats of a vertical blind, and preferably does so in a fashion that prevents blind rattling. This method comprises the steps of: a) providing a clasp having a clip portion for retaining an outer one of the selected plurality of slats and having a string-like tie attached to one of two ends of the clip; b) inserting a portion of the outer one of the selected group of the slats into the clip portion and closing a closure portion of the clip so that the outer one of the slats is clamped between two parallel elongate leg portions of the clip; c) gathering remaining ones of the plurality of slats so that the respective slats are juxtaposed in an abutting relationship to the clip; d) wrapping the string-like tie portion of the clasp around the gathered slats so as to snugly capture them between the tie and the clip; and e) connecting the string-like tie to a tie-retainer portion of the clip and preferably adjusting the tie so as to bind the slats together tightly enough to minimize rattling.

The invention provides yet another method for retaining a plurality of slats of a vertical blind. This method comprises the steps of: a) providing a string-like tie; b) forming, in a selected slat of the plurality of slats, at least one tie retainer for retaining the string-like tie; c) gathering remaining ones of the plurality of slats so that the respective slats are juxtaposed in an abutting relationship to the selected slat; and d) wrapping the string-like tie around the gathered slats and retaining it with the at least one tie retainer so as to snugly hold the remaining ones of the plurality of slats in the abutting relationship.

One of the features of a preferred slat retaining arrangement of the invention is that a portion of the retaining mechanism, e.g., the clip, can be left attached to one slat of a group of slats even when the slats in that group are not retained in a juxtaposed arrangement. That is, the blind can be operated in a conventional fashion after the slat retaining arrangement is installed.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION

Figure 1:
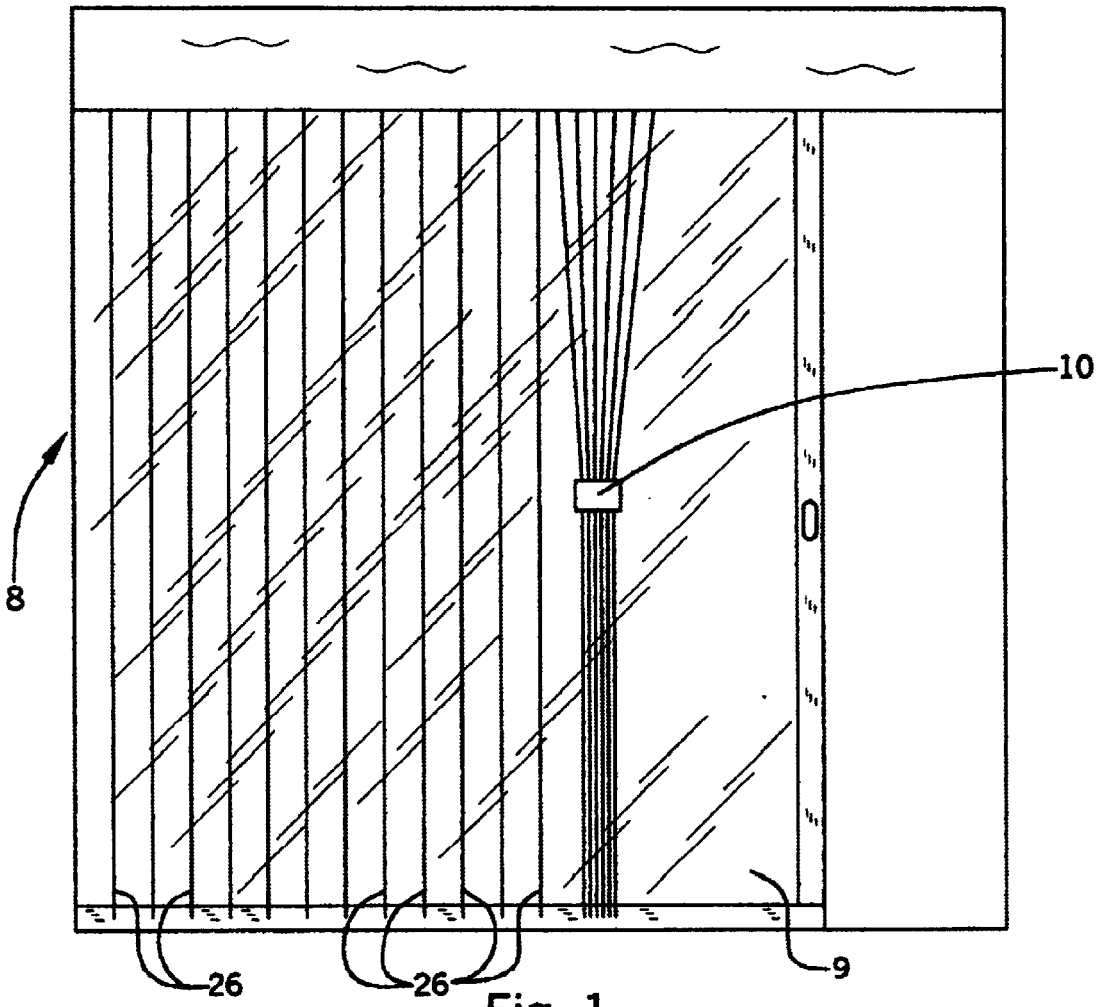
FIG. 1 is an elevational view of a clasp of the invention retaining a group of slats of a vertical blind, where the slats are perpendicular to a plane of a sliding glass door.

A well-known vertical blind 8 comprises a plurality of slats 26 and a mechanism (not shown) that retains a top of each slat and is used both for translating the slats horizontally in front of a window or sliding glass door 9, and for rotating the slats 26 about their longitudinal axes so as to control the amount of light passing through the blind 8. If the window or door 9 is opened at least partially, moderate air currents cause the slats 26 to move back and forth so that they strike into each other and cause an objectionable rattling noise. In some such blinds additional chains (not shown) may be used to connect the bottoms of adjacent slats so as to limit the extent to which adjacent slats can move with respect to each other. These chains do not substantially diminish the extent of rattling caused by moderate air currents, but do prohibit the use of those clasp mechanisms, such as the one taught by Kratzer, that require sliding the clasp mechanism over the slat from a bottom of the slat. A clasp 10 of the invention, however, can be used to retain a selected group of slats (e.g., the group of slats nearest the door opening in the depiction of FIG. 1) so that the retained slats are juxtaposed in an abutting relationship in which they are restrained from moving under the influence of moderate air currents. Although the clasp of the invention 10 can be used regardless of the rotational setting of the slats, it is most effective when the slats 26 are turned perpendicular to the window or door 9, as depicted in FIG. 1. In this setting, which is the one most commonly used if the blind is partially opened to allow a sliding glass door to be opened for ventilation, the portions of the slats below the clasp commonly hang as a single bundle of abutting members, while the portions of the slats above the clasp have a separation that varies with height up to the top of the blind where the blind mechanism imposes a slat-to-slat spacing.

Figure 2:
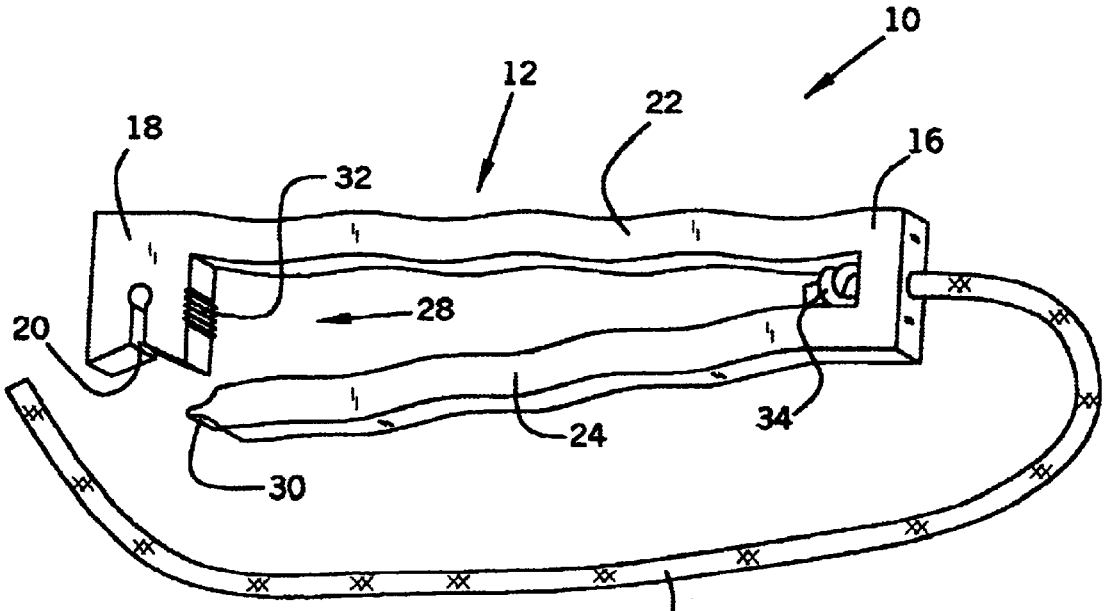
FIG. 2 is an elevational view of a first embodiment of a clasp of the invention.

Turning now to FIG. 2, one finds a preferred clasp 10 of the invention comprising a clip portion 12 and a string-like tie 14 that is preferably attached to a closed end 16 of the clip 12 and that can be releasably attached adjacent the openable end 18 of the clip 12 by a tie-retainer 20. In the depiction of FIG. 2, the clip 12 comprises two elongated legs 22, 24 that are flexibly and permanently connected together adjacent the closed end of the clip by means allowing them to move toward and away from each other. This motion allows the clip to be opened to receive a blind slat 26 which is captured within the clip when the clip is closed by a closure 28, which may comprise the depicted combination of a flexible finger 30 at an end of one of the legs 24 and a serrated surface 32 on a portion of the openable end of the clip. In a preferred embodiment the clip 12 is made from a relatively flexible polymeric material, which allows the two legs 22, 24 to move relative to each other. It will be recognized that many other choices can be made that would provide the same range of motion and include, but are not limited to, the use of a pin hinge in a metal clip. Moreover, it will be recognized that many types of closures can be used to attach the distal ends of the two legs together and may comprise serrated clip portions of the legs as well as the use of fastening means that are not integrally formed with the clip legs.

In some embodiments the clip legs 22, 24 have a serpentine shape when viewed along the length of a slat (see the depiction of FIG. 2). This serpentine shape, coupled with the flexibility of the legs, is useful to ensure clamping contact with slats having a range of thicknesses typical of what is expected to be encountered in practice.

Figure 3:
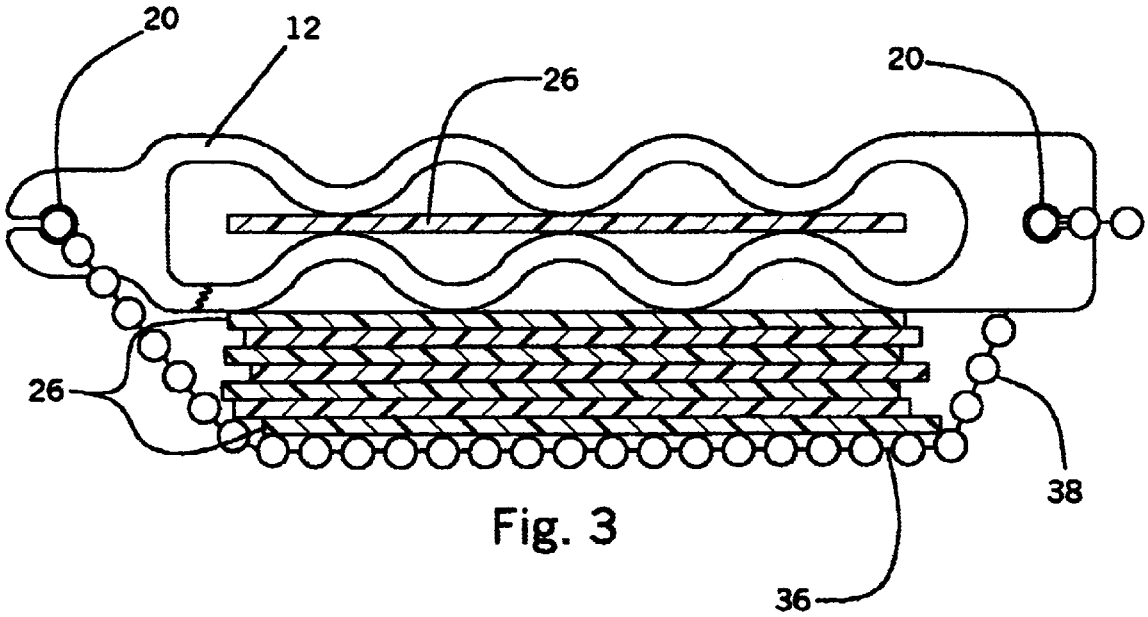
FIG. 3 is a plan view of a second embodiment of the clasp of the invention holding a plurality of vertical blind slats in a juxtaposed arrangement, the blind slats shown in horizontal cross section.

The string-like tie 14 may take many configurations as long as it is flexible enough to wrap around a plurality of slats and hold them, when retained in the retainer 20, juxtaposed against others of the slats. There are many choices for the tie 14, which may comprise a beaded chain or a simple woven string having a keeper knot 34 at one end and having the other end threaded through the closed end 16 of the clip. In a particular preferred embodiment, the tie 14 may comprise a beaded chain of the sort commonly used for key chains and for driving a rotational adjustment mechanism of a vertical blind. It will be recognized that a beaded chain may comprise a plurality of metal balls sequentially connected by wire members, may be a chain-like plastic tie comprising a plurality of balls threaded onto a central fiber, or may be a somewhat flat plastic tie of the sort having alternating regions of smaller 36 and greater 38 widths. Moreover, the tie 14 can be more or less permanently attached to one end of a clip, or may detachably connectable to tie retainers 20 at both ends of the clip, as depicted in FIG. 3.

Figure 4:
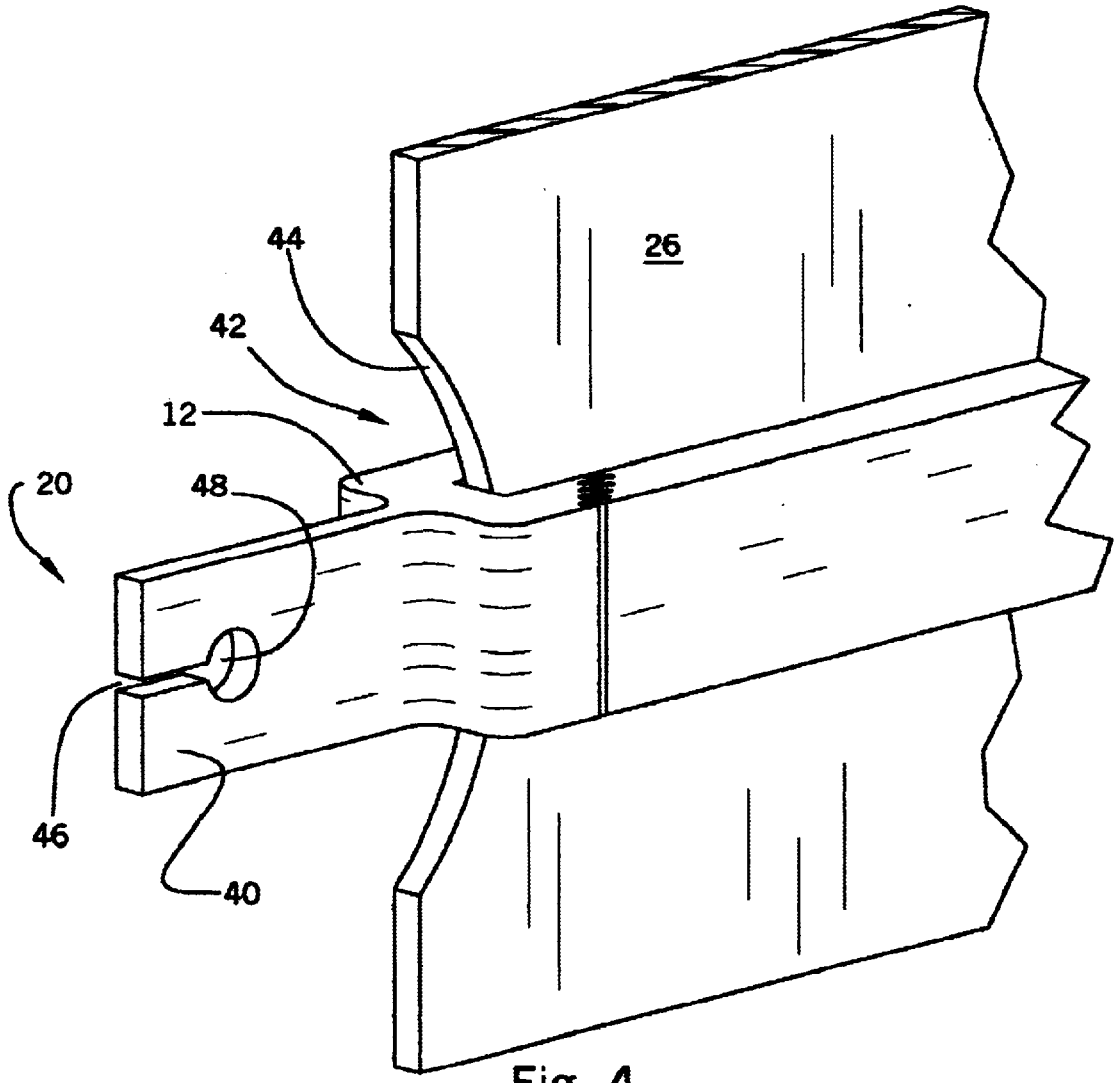
FIG. 4 is an elevational view of an alternate embodiment of a clasp for cooperating with a notched vertical blind slat.

In a preferred embodiment, depicted in FIG. 4, an end of the clip 12 has a thin, flexible tab section 40 formed at one end. A tie retainer 20 is formed in the tab 40 by one or more bifurcating slits 46 that may have widened portions 48 at their roots to aid in retaining a string-like member. This arrangement of two readily deformable tab portions on either side of a slit allows a user to easily connect or disconnect a tie 14 from the end of the clip 12. The combination of a relatively thin, flexible, bifurcated tab and a beaded chain allows a user to pull and secure the chain tightly enough around a group of captured slats to effectively prevent wind rattling. Moreover, this retaining method allows a group of captured slats to be readily released by a gentle tug so that the blind can be repositioned as desired.

A preferred method for retaining or grouping a plurality of slats of a vertical blind comprises the steps of: a) providing a clasp of the sort described above; b) inserting a medial portion of the outer one of the selected group of the slats into the clip portion and using a clip closure to clamp an outer one of the slats within the clip; c) gathering the remaining ones of the plurality of slats in the group so that the respective slats are juxtaposed in an abutting relationship to the clip; d) wrapping the tie around the gathered slats so as to capture the gathered slats between the tie and the clip; and e) connecting the tie to a retainer portion of the clip so as to hold the slats in the preferred abutting relationship. It will be noted in the foregoing that the retaining operation is generally arranged to hold the group of slats together at a selected medial portion of the slats. That is, a traverse mechanism of the vertical blind holds the slats in some relationship to each other at a top of each slat, whereas the apparatus of the invention is intended to hold medial portions of adjacent slats together so as to resist blind rattling caused by air movement, or to provide for a decorative illumination control of the sort taught by Kratzer.

As noted above, it is desirable to not have to completely remove a slat-retaining mechanism when a vertical blind is operated in a conventional fashion. To this end, various arrangements of the invention allow clasps or ties to be left connected to or attached about some of the slats in the blind at all times. When the blind is to have groups of slats retained together, the slats that are not specially equipped or modified are fastened to those that are so equipped or modified by means of ties. In the embodiments of the invention depicted in FIGS. 1 and 2, clips having serpentine legs are used to ensure that the clips do not fall off the slats when not tied to other slats. In the depiction of FIG. 4, on the other hand, a clip 12 cooperates with a modified slat 26 having a notch 42 cut into at least one side of it. In this case the free space enclosed by the clip 12 has a length that is less than the nominal width of the slat 26, but that is greater than the width of the slat measured at the base 44 of the notch.

Figure 5:
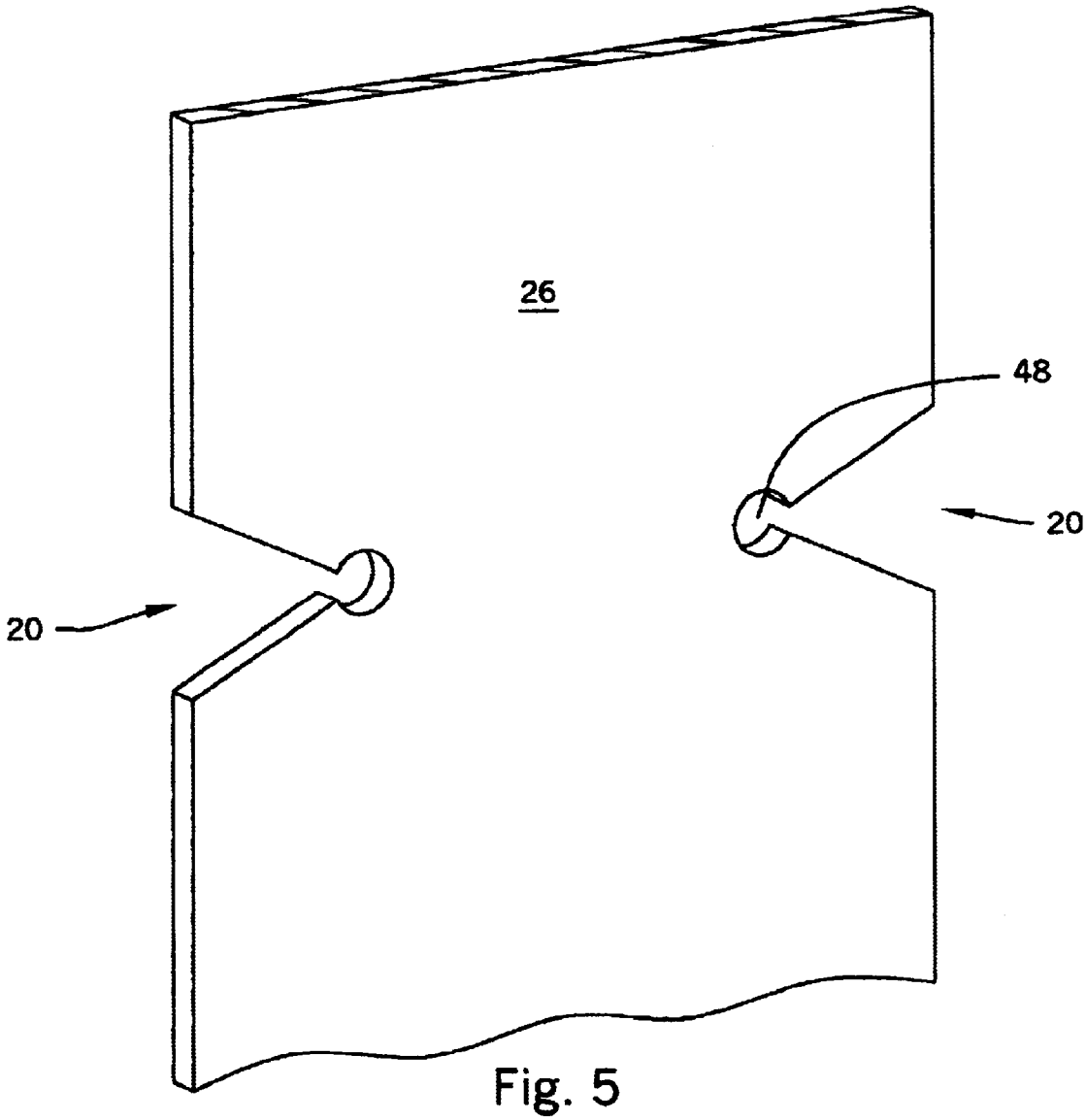
FIG. 5 is an elevational view of a vertical blind slat having tie-retainers formed therein.

Another variation on the method of the invention can be practiced by forming at least one tie-retainer 20 directly in a blind slat 26. In a preferred version of this variation, as depicted in FIG. 5, two tie-retainers 20 of a sort suitable for use with a beaded chain are formed on opposite sides of a slat 26 at a single selected distance from an end of the slat. In other embodiments, a tie can be permanently attached to one side of the slat for use with a single retainer on the other side of the slat. In either event, the method comprises gathering remaining ones of the plurality of slats so that the respective slats are juxtaposed in an abutting relationship to the selected slat and then wrapping the string-like tie around the gathered slats and retaining it in the at least one tie retainer so as to hold the remaining ones of the plurality of slats in the juxtaposed abutting relationship.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. An apparatus comprising, in combination, a clasp and a vertical blind comprising a plurality of substantially planar slats depending from a horizontal track disposed in a plane parallel to an opening for one of a door and a window, the clasp for selectively retaining a first of the slats adjacent at least a second of the slats so that the planes of both the first and second slats are perpendicular to said plane containing said track, each of the slats having a selected slat width over at least most of its length and further having a single selected slat thickness, the clasp comprising:

an elongate clip portion having two ends, the clip portion comprising:

two parallel elongate legs flexibly connected together adjacent a first end thereof, the two legs spaced apart from each other, adjacent the first end of the clip portion, by at least the slat thickness, the respective ends of the legs distal from the first end of the clip portion selectively movable toward and away from each other;

a closure adjacent the second end of the clip portion for releasably connecting the respective distal ends of the two legs so as to define an enclosed area for retaining the first slat; and a tie-retainer adjacent a selected one of the two ends of the clip portion;

the clasp further comprising:

a tie having two ends, the tie having a length greater than the slat width, the first end of the tie attached to the clip portion adjacent that end of the clip portion distal from the tie-retaining portion, the second end of the tie selectively retained by the tie-retainer when the clip portion is disposed about the first slat and the second slat is retained adjacent thereto.

2. The apparatus of claim 1 wherein a length of at least one of the legs of the clasp is greater than the selected slat width.

3. The apparatus of claim 1 wherein the clasp further comprises a second tie retainer for attaching the tie adjacent that end of the clip portion distal from the first tie retainer.

4. The apparatus of claim 1 wherein at least one of the two legs of the clip portion has a serpentine shape.

5. A method for retaining a plurality of slats of a vertical blind, the method comprising the steps of providing a clasp having a clip portion for retaining an outer one of the plurality of slats, the clip portion having two ends;

inserting the outer one of the plurality of slats into the clip portion and closing a closure portion of the clip portion so that the outer one of the slats is clamped between two parallel elongate leg portions of the clip portion;

gathering the remaining ones of the plurality of slats so that the gathered slats are juxtaposed in an abutting relationship to the clip portion; and connecting opposing ends of a flexible, elongate tie to respective ones of two ends of the clip portion so as to capture the gathered slats between the tie and the clip portion.

6. The method of claim 5 wherein the step of connecting the tie comprises pulling the tie tightly around the gathered slats so as to prohibit the gathered slats from being rattled by moving air.

7. An apparatus comprising a combination of a clasp and a vertical blind comprising a plurality of substantially planar slats depending from a horizontal track disposed in a plane parallel to an opening for one of a door and a window, the blind comprising a notched slat having a selected slat width along most of its length, the slat comprising a notched region wherein the width is locally reduced by the notch, the combination of the clasp and the notched slat for selectively retaining at least a second slat when the planes of the first and second slats are oriented perpendicular to said plane containing said track, the clasp comprising:

a clip portion, having two ends, the clip portion defining an elongate internal area having a length greater than the width of the notched slat measured at a base of the notch, the clip portion further comprising two parallel elongate legs flexibly connected together adjacent the first end of the clip portion, the two legs spaced apart from each other, adjacent the first end of the clip portion, by at least a thickness of the notched slat, the respective ends of the legs distal from the first end of the clip portion selectively movable toward and away from each other;

a closure adjacent the second end of the clip portion for releasably connecting the respective distal ends of the two legs to selectively close the clip portion about the notched portion of the notched slat; and a tie-retainer adjacent a selected one of the two ends of the clip portion;

the clasp further comprising:

a tie having a length greater than the selected slat width, a first end of the tie selectively retained by the tie-retainer when the clip portion is disposed about the first slat and the second slat is retained adjacent thereto, a second end of the tie attached to the clip portion adjacent the end thereof that is not the selected end thereof.

8. The apparatus of claim 7 wherein the length of the elongate internal area is less than the selected slat width.

9. The apparatus of claim 7 further comprising a second tie-retainer for attaching the second end of the tie to the clip portion adjacent the second end thereof.

* * * * *